United States Patent [19]

Hicks

[11] 3,985,286

[45] Oct. 12, 1976

[54] SIX-CELL BOX DIVIDER

[75] Inventor: Billy R. Hicks, Winona, Tex.

[73] Assignee: Continental Can Company, Inc., New York, N.Y.

[22] Filed: Apr. 1, 1976

[21] Appl. No.: 672,681

[52] U.S. Cl. ..... 229/15; 206/45.33

[51] Int. Cl.[2] ..... B65D 5/48

[58] Field of Search ..... 229/15, 28 R, 42, 29 D; 206/45.33

[56] References Cited

UNITED STATES PATENTS

| | | | |
|---|---|---|---|
| 1,791,422 | 2/1931 | McVay et al. | 229/15 |
| 3,260,440 | 7/1966 | Foley | 229/15 |
| 3,301,460 | 1/1967 | Harrison | 229/15 |
| 3,317,111 | 5/1967 | Black | 229/15 |
| 3,348,667 | 10/1967 | Beeby | 206/45.33 |
| 3,682,367 | 8/1972 | Rohde et al. | 229/15 |
| 3,756,496 | 9/1973 | Oostdik | 229/15 |
| 3,871,569 | 3/1975 | Wharton, Jr. | 229/15 |
| 3,931,924 | 1/1976 | Gardner et al. | 229/15 |

*Primary Examiner*—Davis T. Moorhead

*Attorney, Agent, or Firm*—H. Lawrence Smith; Joseph E. Kerwin; William A. Dittmann

[57] ABSTRACT

A divider for partitioning a rectangular space into six cells, formed from a blank comprising a central panel and a pair of panel sections. Each of the panel sections includes second, third, fourth and end panels extending in that order from the central panel. The widths of the second and fourth panels are equal, and the width of each end panel is greater than the width of the respective third panel, whereby when the fourth and end panels are folded flatly onto the second and third panels, an end portion of each end panel overlies a portion of the central panel. The blank is cut and further scored along a median portion to provide hinge means and to divide the panels into half-panels.

27 Claims, 13 Drawing Figures

SIX-CELL BOX DIVIDER

BACKGROUND OF THE INVENTION

This invention relates to a divider for partitioning a rectangular space into cells, and more particularly, to a blank for forming a divider adapted to partition the space enclosed by a rectangular carton or box into individual compartments.

In addition to their partitioning function, such dividers may be so constructed that they serve as load-bearing or load-distributing members to enhance the vertical compressive strength of the carton or box in which they are enclosed, thereby affording greater stacking loads and increased resistance to vertical impact. Such considerations have assumed particular importance with increases in the dimensions of pallet loads, modular freight containers, and other unitary packing systems now widely employed in shipping and storage.

The optimum divider of the type under consideration will also be constructed in a manner such that:

a. It may be readily and economically manufactured using conventional equipment and methods;
b. It may be formed of a single piece of material;
c. In shipping and storage prior to use, it will occupy a minimum amount of space relative to its bulk;
d. It may be shipped and stored prior to use in a form of such shape and dimensions that it is easily handled;
e. It may be erected quickly and surely at the point of use with little or no skill, without assembly of discrete elements, and without application of adhesive, tape, staples or other fastening means; and
f. It will add significantly to the strength of the carton or box in which it is employed without substantial increase in weight, substantial decrease in useful capacity, or excesive use of material.

Numerous dividers intended to meet some or all of the foregoing criteria have been proposed heretofore. A number of these are of a type specifically adapted to partition a rectangular space into six cells, since many articles are customarily shipped or sold in units of six or multiples of that number.

One such divider and the blank therefor are shown and described in U.S. Pat. No. 3,260,440, issued July 12, 1966 to T. L. Foley. More particularly, the latter patent discloses a blank for forming a divider adapted to partition a rectangular space into six cells, the blank having formed therein a plurality of spaced score lines parallel with one another and with opposite ends of the blank. The blank comprises a central panel and a pair of panel sections, each panel section including second, third, fourth and end panels extending in that order from the central panel to a respective one of the ends of the blank. Adjacent panels are hingedly connected to one another along one of the parallel score lines, the widths of the panels thereby being determined by the locations of the parallel score lines. The widths of the second panels are substantially equal to one another and to the widths of the fourth panels. The blank is cut and further scored along a median portion thereof which forms right angles with the parallel score lines and which divides the panels into half-panels.

The foregoing features are also common to blanks formed in accordance with the present invention. However, unlike the present invention, in each of the panel sections of the prior blank the width of the end panel is not greater than half the width of the third panel. Also, the width of the central panel is more than three times the width of the third panel and more than six times the width of the end panel.

Further in accordance with the teaching of the aforementioned patent, the knocked-down form of the divider is achieved by folding the third, fourth and end panels flatly onto the central and second panels, whereby the end panels in their entirety overlie a central portion of the central panel, and the blank so folded is then folded flatly about the median portion in a direction such that the central half-panels lie between the end half-panels. It is to be noted that the end panels, and thus the end edges of the blank, are therefore entirely exposed in both the flatly folded and erect conditions. This manner of folding is not optional; it must be followed if the blank disclosed is to form a divider providing six cells of rectangular cross section. The area of one face of the knocked-down divider (or twice-folded blank) is approximately one fourth of the area of one face of the unfolded blank. In the erected form, the relatively wide central panel extends from end to end of the divider, in itself forming a wall of each of four cells, and cooperating with the end panels to form a wall of each of the two remaining cells.

SUMMARY OF THE INVENTION

In accordance with the present invention, in each panel section the width of the end panel is greater than the width of the third panel, but the sum of the width of the end panels is not greater than the sum of the widths of the central panel and third panels. This construction permits the fourth and end panels to be folded flatly onto the central, second and third panels with only an end portion of the end panel overlying a respective portion of the central panel. The blank may then be folded flatly about the median portion in a direction such that the end portions of the end panels lie between the central half-panels. Thus the end portion and consequently the end edges of the blanks are contained between the central half-panels in both the knocked-down and erect conditions.

Here too the area of one face of the twice-folded blank will be approximately one fourth of the area of one face of the unfolded blank. When the divider is erected, each of the end panels alone forms a wall common to two of the six cells, and the end portions of the end panels cooperate with the central panel to form a wall common to the two remaining cells.

In certain forms of the invention the panel sections are identical, whereby the widths of the third panels are substantially equal, and the width of the central panel is substantially equal to the width of each of the third panels. Such forms provide a divider in which the six cells have approximately uniform dimensions.

These and other features, objects and advantages of the invention will be apparent from the following description taken in conjunction with the accompanying drawings.

THE DRAWINGS

THE PREFERRED EMBODIMENTS

Figure 1:
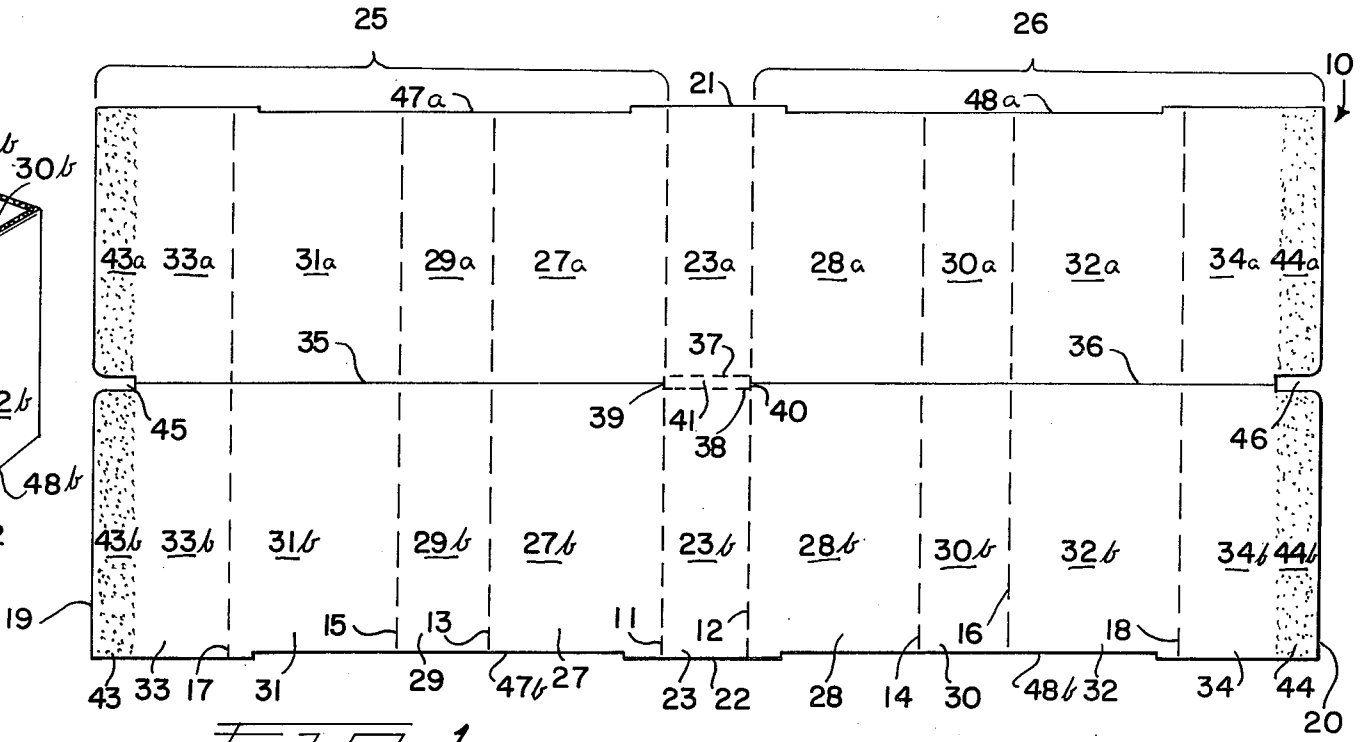
FIG. 1 is a plan view of one face of a divider blank which comprises one embodiment of the invention.

Referring particularly to FIG. 1, there is shown one face of a blank 10 which is constructed in accordance with the invention and which may be formed from a single piece of material. In this instance, the material is double-faced corrugated fibreboard; however, it will be apparent that any other suitable, substantially rigid but foldable material may be substituted. A view of the opposite face of the blank would be identical with FIG. 1 except that, for reasons which will become clear from the following description, the stippling would be absent.

Formed in the blank are a plurality of spaced score lines 11 to 18, inclusive, which are parallel with one another, with opposite ends 19 and 20 of the blank, and with the corrugated flutes, not visible in FIG. 1. The score lines traverse the blank between opposed peripheral edges 20 and 21 thereof which intersect ends 19 and 20 and cooperate therewith to establish a generally rectangular blank outline. Like all score lines shown and described herein, score lines 11 to 18 may be formed in any suitable manner, such as by impression, ruling, interrupted cutting or slitting, or perforation.

Blank 10 comprises a central panel 23 and a pair of identical panel sections 25 and 26, each panel section including a second panel 27, 28, a third panel 29, 30, a fourth panel 31, 32 and an end panel 33, 34, extending in that order from the central panel to the respective one of ends 19 and 20. Adjacent ones of the panels are hingedly connected to one another along one of score lines 11 to 18, the widths of the panels thereby being determined by the locations of the score lines. It should be pointed out that score lines 11 and 12 may be considered reversed scores relative to score lines 13 to 18. For example, referring to FIG. 1, panels 23 and 27 are intended to be rotated relative to one another about score line 11 in directions away from the viewer, whereas panels 29 and 31 are intended to be rotated relative to one another about score line 15 in directions towards the viewer.

Panel sections 25 and 26 being identical, second panels 27 and 28 are equal to one another in width, and the same is true of third panels 29 and 30, fourth panels 31 and 32, and end panels 33 and 34. Further, second panels 27 and 28 are substantially equal in width to fourth panels 31 and 32, this relationship being required if the erected divider is to occupy a rectangular space, as will be apparent by referring particularly to FIG. 4, and central panel 23 is substantially equal in width to each of third panels 29 and 30. On the other hand, the width of each of end panels 33 and 34, as shown, is slightly less than one-and-one half times the width of central panel 23 (and of each of third panels 29 and 30). This factor of 1.5 comprises the upper limit of the width of each of the end panels if the latter are to be identical. At the lower limit, the width of each end panel is at least slightly greater than the width of the central panel (and each of the third panels).

Figure 4:
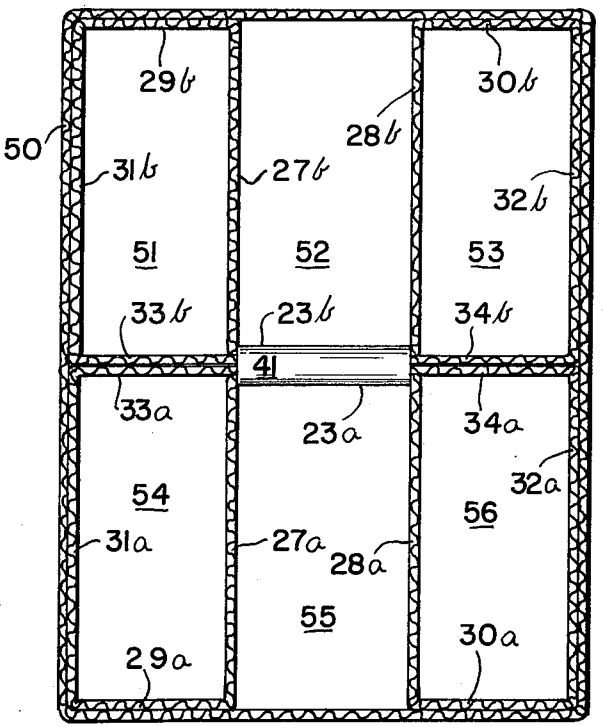
FIG. 4 is an enlarged view from above of the divider of FIG. 3 and the sidewall of a box in which the divider is received.

While the foregoing relationships between the widths of the panels must be maintained if the resulting divider is to provide cells of substantially uniform, rectangular cross section, it is pointed out that there is no prescribed relationship between the width common to panels 27, 28, 31 and 32 on the one hand and the width common to panels 23, 29, and 30 on the other hand. As shown, the ratio is approximately 2:1 to provide cells which in their transverse dimensions are about twice as deep as they are wide, as best seen in FIG. 4. It will be apparent, however, that this ratio can be varied infinitely within practicable limits to provide cells having transverse dimensions appropriate to the dimensions of the articles they are intended to receive and the dimensions of the carton or box employed.

On the other hand, in some applications, it may be desirable to provide cells having varying widths as viewed in FIG. 4. In such a case, the width of central panel 23 need have no particular relation to the width of each of third panels 29 and 30, and indeed panel sections 25 and 26 need not be identical. In the broader aspects of the invention it is necessary only that in each of the panel sections the width of end panel 33, 34 be greater than the width of third panel 29, 30, and that the sum of the widths of the end panels be not greater than the sum of the width of the third panels and central panel 23.

Blank 10 is cut and further scored along a median portion thereof forming right angles with score lines 11 to 18 to divide each of the panels into half-panels distinguished from each other in the drawings by adscript characters *a* and *b*. More particularly, a pair of cut lines 35 and 36 extend continuously in opposite directions from central panel 23 to ends 19 and 20, respectively, each cut line thereby traversing a respective one of panel sections 25 and 26. The cut lines coincide with an imaginary median line of the blank; that is, a line equidistant from edges 21 and 22.

Traversing central panel 23 is a hinge means provided by a pair of hinge score lines 37 and 38 which coincide with a pair of imaginary hinge lines parallel with one another and equidistant from the median line. The median line and the hinge lines cooperate to define the previously mentioned median portion of the blank.

A pair of transverse cut lines 39 and 40, coincident with score lines 11 and 12, respectively, intersect hinge score lines 39 and 40 at opposite ends thereof. Transverse cut line 39 also intersects median cut line 35 at its inner end, and transverse cut line 40 is similarly related to median cut line 36. Hinge score lines 37 and 38 and transverse cut lines 39 and 40 define a hinge portion 41 therebetween which, with the hinge score lines, hingedly interconnects the central half-panels. Preferably the width of the hinge portion between the hinge score lines is approximately equal to four thicknesses of the material of the blank, for a reason which will be made apparent hereinafter.

End portions 43 and 44 of end panels 33 and 34, respectively, have a width equal to the excess in width of each end panel over the respective third panel 29, 30 and are stippled in FIG. 1 to represent a coating of adhesive. The adhesive coating is optional, though preferred, and is applied to only one face of the blank.

That portion of each median cut line 35, 36 traversing the respective end portion 43, 44 is enlarged to form an open-ended slot 45, 46 centered on the median line, the length of the slot being at least equal to the width of the respective end portion, the width of the slot being at least equal to the distance between hinge scorer lines 37 and 38. The slots divide the end portions into half-portions 43*a*, 43*b*, 44*a* and 44*b*.

It will be recognized from the foregoing description, taken in conjunction with FIG. 1, that blank 10 may be readily and economically manufactured from a single piece of material, using conventional equipment and methods. While the blank might be delivered to the user in the form illustrated in FIG. 1, it will usually be preferable that the following preparation be carried out at the point of manufacture rather than at the point of use.

Figure 2:
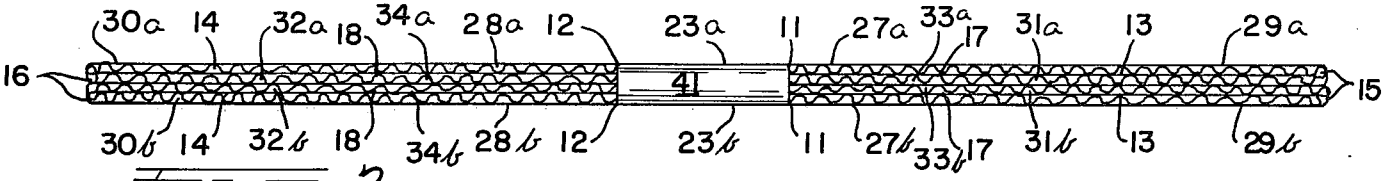
FIG. 2 is an enlarged elevational view of one side of the blank of FIG. 1 fully folded for shipment and storage.
Figure 6:
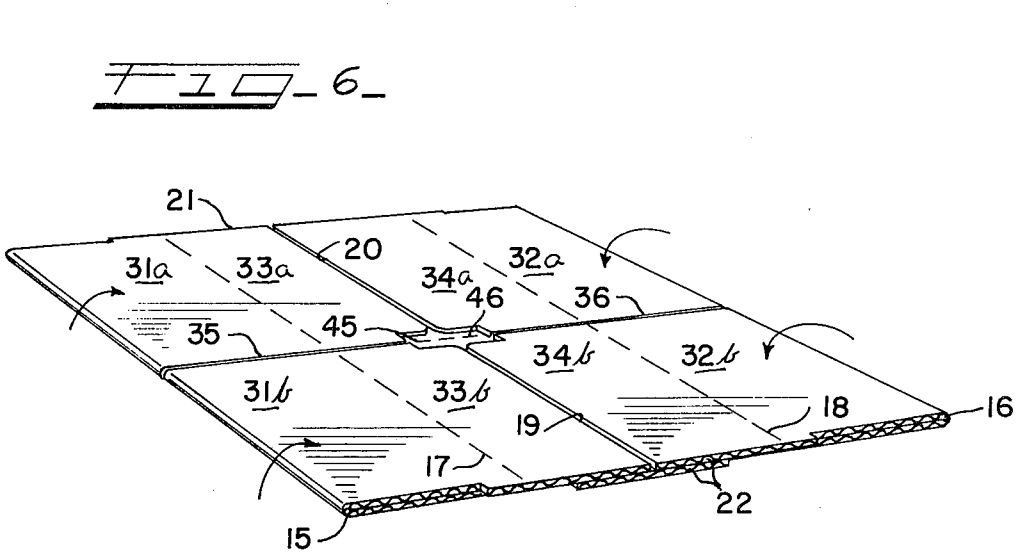
FIG. 6 is a perspective view of the blank of FIG. 1 in an intermediate folded condition.

This preparation requires two folding operations to arrive at the condition illustration in FIG. 2. In the first of these, fourth panel 31 and end panel 33 are folded as a unit about score line 15, and fourth panel 32 and end panel 34 about score line 16, towards the viewer with reference to FIG. 1, until the fourth and end panels of each panel section lie flat upon the respective second panel 27, 28 and third panel 29, 30, with end portion 43, 44 overlying a respective portion of center panel 23. This intermediate folded condition is illustrated in FIG. 6.

Figure 7:
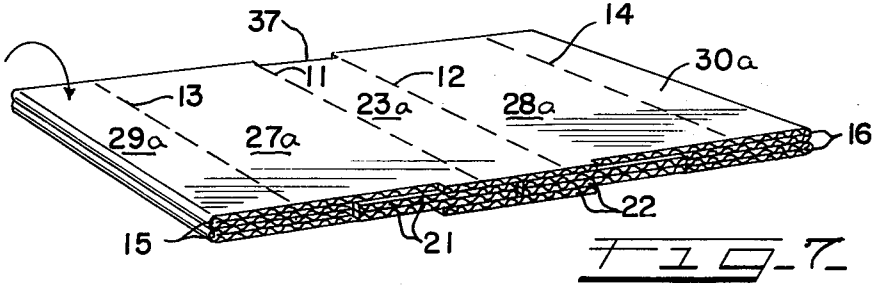
FIG. 7 is a perspective view of the blank of FIG. 1 in the fully folded condition of FIG. 2 but showing a side of the folded blank opposite the side shown in FIG. 2.

Next, the once-folded blank is folded flatly about the median portion in a direction such that end half-portions 43*a*, 43*b*, 44*a* and 44*b* lie between central half-panels 23*a* and 23*b*. This, the knocked-down form of the divider; that is, the form in which it is fully folded for shipment and storage, is shown in FIGS. 2 and 7. In this entirely flattened form the divider occupies a minimum amount of space relative to its bulk and is easily handled. More particularly, it remains rectangular in outline, but the area of one face is approximately one-fourth of the area of one face of the unfolded blank. In addition, being four times as thick as the unfolded blank, it is much more rigid during handling.

Figure 5:
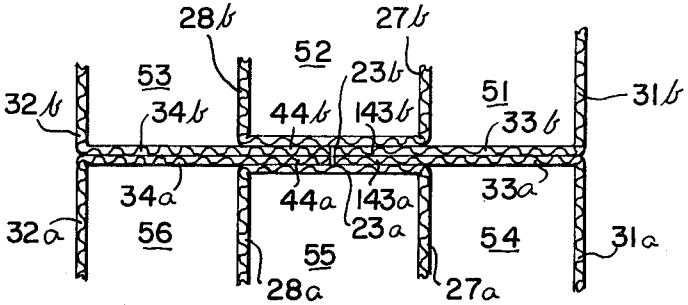
FIG. 5 is a partial view from below of the divider of FIGS. 3 and 4, and also of the divider of FIGS. 10 and 11.

Since, as previously mentioned, the width of hinge portion 41 between hinge score lines 37 and 38 is approximately equal to four thicknesses of the material of the blank, end portions 43 and 44 are readily accommodated between center half-panels 23*a* and 23*b*, as is best seen in FIG. 5.

Figure 3:
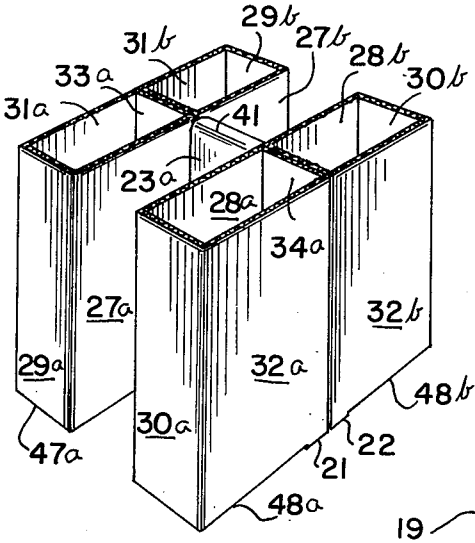
FIG. 3 is a reduced perspective view of a divider erected from the blank of FIGS. 1 and 2.

Referring to FIGS. 3 and 7, it will be noted that with the construction shown, hinge portion 41 is recessed below the edges formed by cut lines 35 and 36 in the knocked-down and erect forms of the divider. Slots 45 and 46 provide indentations in end half-portions 43*a*, 43*b*, 44*a* and 44*b* so that they will be accommodated without difficulty under hinge portion 41. It will be readily apparent that, if desired, cut lines 35 and 36 can be widened to slot form throughout their lengths in order to make hinge portion 41 flush, or nearly so, with adjacent surfaces of the divider when it is fully folded or erect.

At the time the first folding operation described above is carried out, end portions 43 and 44 are preferably fastened to the respective portions of center panel 23 which they overlie. This prevents the divider from unfolding during handling and facilitates setting up at the point of use. Preferably an adhesive is provided between the end portions and the central panel to maintain the overlapping relationship during subsequent handling. Obviously the adhesive may be applied to the end portions before folding, as indicated in FIG. 1, or it may be applied to the central panel. Alternatively, gummed tape, staples or the like may be used.

Figure 8:
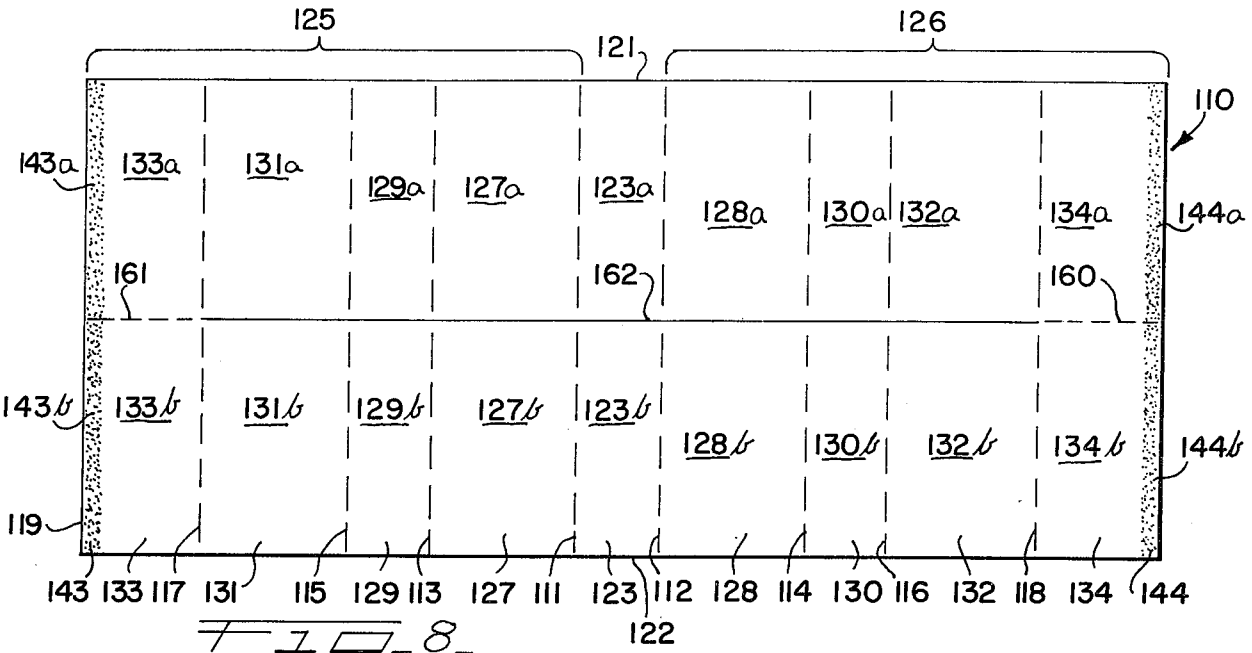
FIG. 8 is a plan view of one face of a divider blank which comprises an alternative embodiment of the invention.
Figure 9:
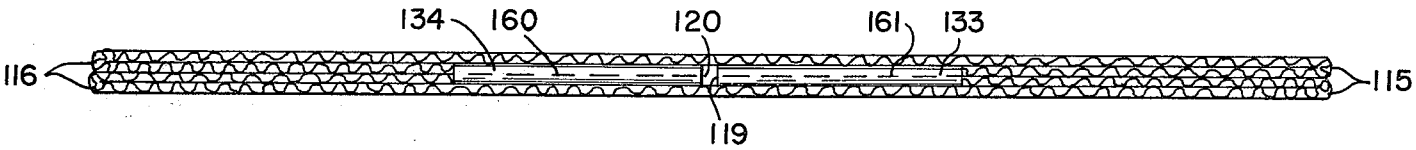
FIG. 9 is a view similar to FIG. 2 but of the blank of FIG. 8.
Figure 10:
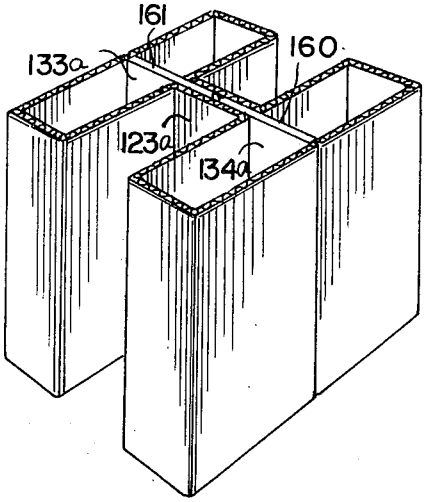
FIG. 10 is a view similar to FIG. 3 but of a divider erected from the blank of FIGS. 8 and 9.

Referring particularly to FIG. 1, peripheral edges 21 and 22 may be provided with a pair of indentations 47*a* and 48*a*, and 47*b* and 48*b*, respectively. In the embodiment shown, each indentation traverses the width of third panel 29, 30 and adjacent portions of second panel 27, 28 and fourth panel 31, 32. The indentations of both edges 21 and 22 are identical, whereby they match when the blank is folded flatly about the median portion. As will be apparent in FIG. 3, the indentations are provided to accommodate the minor or inside flaps of the bottom of a corrugated box of the type commonly called a regular slotted container. The indentations may be modified as necessary when the divider is to be used with other types of box or carton, or they may be omitted altogether, as in FIG. 8. If the box or carton is formed of the same material as the divider, the depth of the indentations should not exceed the thickness of the material if the divider is to be optimally utilized to augment the compressive strength of the container.

The divider is readily erected from the knocked-down form of FIGS. 2 and 7 to that shown in FIGS. 3, 4 and 5 by pressing inwardly at score lines 15 and 16 toward central half-panels 23*a* and 23*b*. When the erected divider is placed in a box, the sidewall 50 of which is represented in FIG. 4, the rectangular space enclosed by the box is divided into six cells 51 to 56, inclusive.

As is well known, corrugated structures exhibit their greatest compressive strength at their corners. The divider of the present invention provides no less than sixteen corners in addition to the four corners provided by the box itself.

Further, as is best shown in FIG. 5, a central wall of the divider, equidistant from the ends of the box, is of double thickness throughout two-thirds of its extent, and of quadruple thickness substantially throughout a central third thereof, providing in effect a central pillar or pier.

Turning now to the embodiment illustrated in FIGS. 8 to 13, in which features similar to those shown in FIGS. 1 to 7 are designated by reference numerals one hundred numbers greater, there is shown a blank 110 almost identical with blank 10 but lacking indentations 47 and 48, and more importantly, differing in the arrangement of the median portion about which the blank is finally folded. Here, the median portion consists of a single median line equidistant from peripheral edges 121 and 122. Each of end panels 133 and 134 is scored along the median line at 161 and 160, respectively. The remaining panels, including central panel 123, are traversed by a single continuous cut line 162 extending between the end panels. If desired, the cut line may extend into the end panels, and in fact only a portion of each end panel need be scored. However, the arrangement shown is preferred for ease and certainty in folding and erecting the divider.

Figure 12:
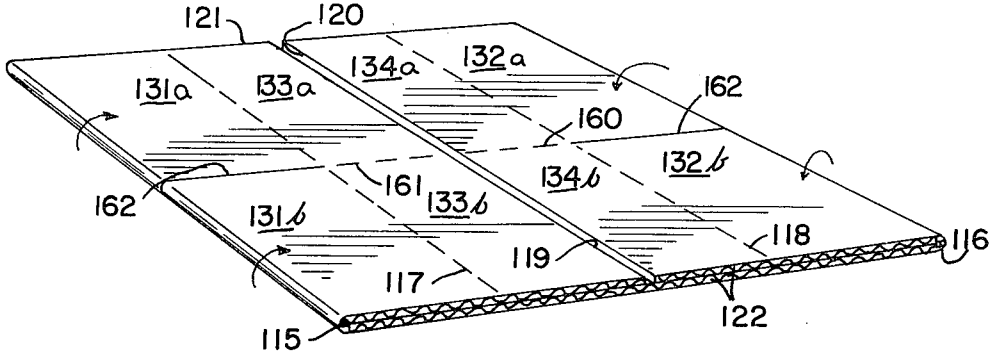
FIG. 12 is a view similar to FIG. 6 but of the blank of FIG. 8.
Figure 13:
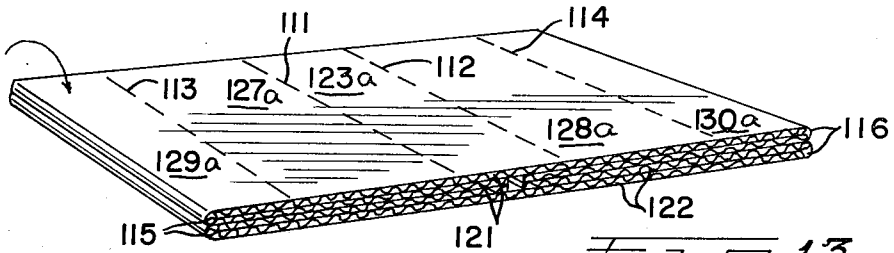
FIG. 13 is a view similar to FIG. 7 but of the blank of FIG. 8.
Figure 11:
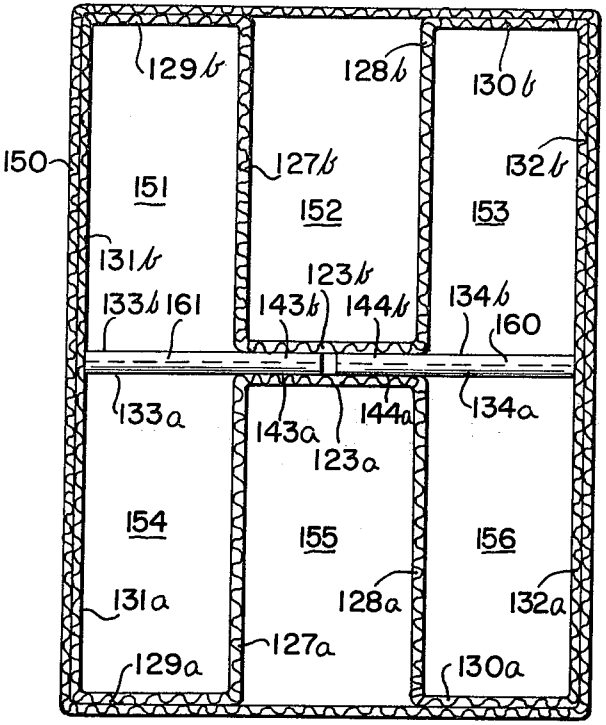
FIG. 11 is a view similar to FIG. 4 but of the divider of FIG. 10.

A divider formed from blank 110 will be virtually identical to one formed from blank 10 in function and effect and is prepared in the same manner, as will be apparent in FIGS. 12 and 13. It will also be apparent that although the reference numerals of FIG. 5 apply to the embodiment of FIG. 1, the former is equally a representation of the embodiment of FIG. 8.

While the invention has been particularly described in connection with certain specific embodiments thereof, it is to be understood that this is by way of illustration and not of limitation, and that the scope of the appended claims should be construed as broadly as the prior art will permit.

What is claimed is:

1. A blank for forming a divider adapted to partition a rectangular space into six cells, the blank having formed therein a plurality of spaced score lines parallel with one another and with opposite ends of the blank, the blank comprising a central panel and a pair of panel sections, each panel section including a second panel, a third panel, a fourth panel, and an end panel extending in that order from the central panel to a respective one of said ends, adjacent ones of the panels of the blank being hingedly connected to one another along one of the parallel score lines, the widths of the panels thereby being determined by the locations of the score lines, the widths of the second panels being substantially equal to one another and to the widths of the fourth panels, in each of the panel sections the width of the end panel being greater than the width of the third panel, the sum of the widths of the end panels being not greater than the sum of the widths of the central panel and third panels, whereby when the fourth and end panels of each panel section are folded flatly onto the second and third panels thereof, an end portion of each panel will overlie a respective portion of the central panel, the blank being cut and further scored along a median portion thereof forming right angles with the parallel score lines to provide hinge means and cut line means dividing the panels into half-panels, the cut line means traversing at least the second, third and fourth panels.

2. A divider blank as defined in claim 1, wherein the panel sections are substantially identical, whereby the widths of the third panels are substantially equal.

3. A divider blank as defined in claim 2, wherein the width of the central panel is substantially equal to the width of each of the third panels, whereby the width of each end panel is greater than the width of the central panel.

4. A divider blank as defined in claim 3, wherein the width of each end panel is not greater than one and one-half times the width of the central panel.

5. A divider blank as defined in claim 1, wherein the central panel is scored along the median portion to provide the hinge means, whereby the central half-panels are hingedly interconnected by the hinge means.

6. A divider blank as defined in claim 5, wherein the end panels are cut along the median portion, whereby the cut line means comprises a pair of median cut lines extending continuously in opposite directions from the central panel to said ends of the blank.

7. A divider blank as defined in claim 1, wherein the median portion comprises a pair of hinge lines parallel with each other, and a median line centered therebetween and parallel therewith, the central panel being scored along the hinge lines to provide the hinge means, whereby the central half-panels are hingedly interconnected by the hinge means, the end panels being cut along the median line, whereby the cut line means comprises a pair of median cut lines extending continuously in opposite directions from the central panel to said ends of the blank.

8. A divider blank as defined in claim 7, wherein a pair of transverse cut lines intersect the hinge lines and the median line at opposite ends of the hinge means.

9. A divider blank as defined in claim 7, wherein that portion of each median cut line traversing the end portion of the respective end panel is enlarged to form an open-ended slot centered on the median line, the length of the slot being at least equal to the width of the end portion, the width of the slot being at least equal to the distance between the hinge lines.

10. A divider blank as defined in claim 7, wherein the width of the hinge means between the hinge lines is approximately equal to four thicknesses of the material of the blank.

11. A divider blank as defined in claim 1, having a pair of opposed peripheral edges intersecting said ends, preselected portions of said edges being indented, the indented portions of one peripheral edge matching the indented portions of the other peripheral edge when the blank is folded flatly about the median portion.

12. A divider blank as defined in claim 1, having a pair of opposed peripheral edges intersecting said ends, each peripheral edge having a pair of indentations therein, each indentation traversing the width of a respective one of the third panels and adjacent portions of the widths of the second and fourth panels, the depth of the indentations being not greater than the thickness of the material of the blank.

13. A divider blank as defined in claim 1, wherein at least a portion of each end panel is scored along the median portion to provide the hinge means, whereby the end half-panels are hingedly interconnected by the hinge means.

14. A divider blank as defined in claim 13, wherein the central panel is cut along the median portion, whereby the cut line means comprises a single continuous cut line extending from one of the end panels to the other of the end panels.

15. A divider blank as defined in claim 13, wherein the median portion consists of a median line.

16. A divider blank as defined in claim 1, including an adhesive coating on at least a part of one face of the end portion of each end panel.

17. A divider for partitioning a rectangular space into six cells, comprising a blank having formed therein a plurality of spaced score lines parallel with one another and with opposite ends of the blank, the blank comprising a central panel and a pair of identical panel sections, each panel section including a second panel, a third panel, a fourth panel, and an end panel extending in that order from the central panel to a respective one of said ends, adjacent ones of the panels of the blank being hingedly connected to one another along one of the parallel score lines, the widths of the panels thereby being determined by the locations of the score lines, the widths of the second panels being substantially equal to one another and to the widths of the fourth panels, in each of the panel sections the width of the end panel being greater than the width of the third panel, the sum of the widths of the end panels being not greater than the sum of the widths of the central panel and third panels, an end portion of each end panel overlapping a respective portion of the central panel, the width of each end portion being substantially equal to the width of the respective end panel less the width of the respective third panel, the end portions cooperating with the central panel to provide a central divider section, the blank being cut and further scored along a median portion thereof forming right angles with the parallel score lines to divide each of the panels into a pair of half-panels and to provide a hinge portion traversing the central divider section, at least the second, third and fourth panels being cut along the median portion.

18. A divider as defined in claim 17, wherein the panel sections are substantially identical, whereby the widths of the third panels are substantially equal.

19. A divider as defined in claim 18, wherein the width of the central panel is substantially equal to the width of each of the third panels, whereby the width of each end panel is greater than the width of the central panel.

20. A divider as defined in claim 19, wherein the width of each end panel is not greater than one and one-half times the width of the central panel.

21. A divider as defined in claim 17, wherein the end portion of each end panel is fastened to the respective portion of the central panel.

22. A divider as defined in claim 17, including an adhesive between the end portion of each end panel and the respective portion of the central panel, the adhesive maintaining the end portions in overlapping relationship with the central panel.

23. A divider as defined in claim 17, folded flatly about the median portion thereof in a direction such that the end portions of the end panels lie between the central half-panels.

24. A divider as defined in claim 17, wherein the central panel is scored along the median portion to provide the hinge portion whereby the central half-panels are hingedly interconnected by the hinge portion.

25. A divider as defined in claim 24, wherein the end panels are cut along the median portion.

26. A divider as defined in claim 17, wherein at least the end portions of the end panels are scored along the median portion to provide the hinge portion, whereby the end half-panels are hingedly interconnected.

27. A divider as defined in claim 26, wherein the central panel is cut along the median portion.

* * * * *